US005409313A

United States Patent [19]

Funk

[11] Patent Number: 5,409,313

[45] **Date of Patent: * Apr. 25, 1995**

[54] APPARATUS FOR HIGH SHEAR MIXING OF FINE POWDERS

[76] Inventor: James E. Funk, 301 Maple Ave., Seneca, S.C. 29678

[ * ] Notice: The portion of the term of this patent subsequent to Mar. 8, 2011 has been disclaimed.

[21] Appl. No.: 206,769

[22] Filed: Mar. 7, 1994

Related U.S. Application Data

[63] Continuation-in-part of Ser. No. 3,523, Jan. 12, 1993, Pat. No. 5,292,193.

[51] Int. Cl.[6] ..... B01F 7/26

[52] U.S. Cl. ..... 366/307; 366/317; 241/162; 241/298; 416/228

[58] Field of Search ..... 366/293, 307, 315–317; 241/16, 21, 144, 159, 162, 297, 298; 261/83, 93; 416/223 R, 228, 231 A

[56] References Cited

U.S. PATENT DOCUMENTS

| | | | |
|---|---|---|---|
| 1,692,617 | 11/1928 | Bowen | 366/316 X |
| 2,159,856 | 5/1939 | MacLean | 366/307 |
| 2,268,038 | 12/1941 | Knittel | 366/314 X |
| 2,598,469 | 5/1952 | Von Korshenewsky | 416/231 A X |
| 2,871,000 | 1/1959 | Dowling | 416/231 A X |
| 3,030,083 | 4/1962 | Stiffler | 416/199 |
| 3,044,750 | 7/1962 | Schmitt, Jr. | 366/316 X |
| 3,100,628 | 8/1963 | Norris, Jr. | 366/317 |
| 3,222,038 | 12/1965 | Ashcraft | 241/162 X |
| 3,464,636 | 9/1969 | Byers | 366/315 X |
| 3,630,636 | 12/1971 | Hill | 416/231 A X |
| 3,638,917 | 2/1972 | Osten | 366/316 X |
| 3,746,467 | 7/1973 | Buse | 416/228 X |
| 4,282,006 | 8/1981 | Funk | 406/197 X |
| 4,365,988 | 12/1982 | Graham et al. | 366/317 X |
| 4,813,787 | 3/1989 | Conn | 366/317 X |

FOREIGN PATENT DOCUMENTS

| | | | |
|---|---|---|---|
| 1297805 | 5/1962 | France | 416/228 |
| 2229465 | 12/1974 | France | 241/282.1 |
| 1211905 | 3/1966 | Germany | 366/315 |
| 1442687 | 10/1969 | Germany | 366/316 |
| 2434744 | 1/1976 | Germany | 416/228 |
| 2194166 | 3/1988 | United Kingdom | 366/316 |
| 1567256 | 5/1990 | U.S.S.R. | 366/317 |

*Primary Examiner*—David A. Scherbel
*Assistant Examiner*—Charles Cooley
*Attorney, Agent, or Firm*—Howard J. Greenwald

[57] ABSTRACT

An apparatus for deagglomerating powder in a mixture of liquid and powder. This apparatus contains a mixing tank, an agitator disk disposed within the mixing tank, and a baffle. The agitator disc has a maximum dimension of from about 6 to about 40 inches. The disc contains a multiplicity of compound teeth radially and removably attached its perimeter. Each of the compound teeth is comprised of a substrate to which is attached a front plate which preferably consists of a ceramic material, such as tungsten carbide.

6 Claims, 5 Drawing Sheets

APPARATUS FOR HIGH SHEAR MIXING OF FINE POWDERS

CROSS-REFERENCE TO RELATED PATENT APPLICATION

This is a continuation-in-part of applicant's copending patent application U.S. Ser. No. 08/003,523, filed Jan. 12, 1993, now U.S. Pat. No. 5,292,193.

FIELD OF THE INVENTION

An apparatus for the high shear mixing and deagglomeration of fine powders in crowded suspensions which utilizes a specified disc agitator and baffle arrangement.

BACKGROUND OF THE INVENTION

Blending devices are well known to those skilled in the art. Thus, for example, U.S. Pat. No. 4,813,787 of Conn discloses a blending apparatus containing a rotating disc, or discs, comprising two features: (a) holes in the disc with louvers of various size and shape to transport material axially through the disc for improved blending, and (b) tangentially arranged teeth at the perimeter of the disc, bent up and down at various angles to the plane of the disc to serve as "masticaters."

U.S. Pat. No. 3,630,636 of Hill discloses a mixing apparatus comprised of two rotating discs, each of which include oppositely disposed slot deflectors arranged in two concentric circular arrays to transport material through the holes in opposing directions. These discs have no teeth on their perimeters.

U.S. Pat. No. 3,222,038 of Ashcraft discloses a mixing machine comprised of three discs, the top and bottom rotating counterclockwise and the middle disc rotating clockwise. Vanes above the top disc and below the bottom disc feed the material from above and below the stack of three discs, through concentrically located holes in each disc, into the middle disc, thus maximizing mixing, dispersion, or comminution.

U.S. Pat. No. 3,030,083 of Stiffler discloses an agitator wheel comprised of two rotating discs, both of which have radial slots and concentric rows of holes. The purpose of the slots is to allow the leading edge of the slot to be bent upward and the trailing edge of the slot to be bent downward, or the reverse, to impart an axial flow of the viscous material. Each disc has its slot edges bent in the opposite direction relative to the other one in order to force the viscous material against itself between the two discs thus maximizing shear forces.

U.S. Pat. No. 2,871,000 of Dowling discloses a glass stirring device which contains a plurality of discs on a single shaft each containing holes which are not in registry with those in an adjoining disc. The discs are joined together with radially mounted webs between them. These webs also have non registering holes in them to force a molten glass to the perimeter of the vessel and into intimate contact with the glass at the perimeter. The non registry of the holes in both discs and webs is designed to maximize the tortuosity of the flow path the glass must traverse thereby maximizing mixing efficiency.

U.S. Pat. No. 2,598,469 of Korshenewsky discloses a rotor for homogenizers with various shaped grooves on its surface only.

U.S. Pat. No. 2,268,038 of Knittel discloses a mixing machine which contains a depressed center disc rotor mounted at the bottom of a tank. The disc has agitator louvers extending radially and upwardly from the upper surface of the rim. Beneath these louvers are holes connecting the top and bottom of the disc. Beneath the outer rim are angled impeller vanes. Within the depressed center are agitator vanes.

The disclosure of each of the aforementioned patents is hereby incorporated by reference into this specifications. The discs used in the devices of these patents comprise unprotected protrusions above and/or below the disc(s) and holes through the discs. None of these patents have addressed the problem of severe wear due to abrasion by large particles, or the energy necessary to effectively deagglomerate fine powders; and none of these patents has provided a solution to this problem.

The Shar Mixer Company of Fort Wayne, Texas, for example, produces a mixer which uses an agitator disc with flame-sprayed tungsten carbide coatings on its steel teeth. Although this agitator is somewhat more durable than a similar agitator which uses uncoated steel teeth, it still has a relatively short life when used with crowded hard particulate suspension systems.

It is an object of this invention to provide an apparatus for the high shear mixing and deagglomeration of fine powders in crowded suspensions which is substantially more durable and effective than prior art devices.

SUMMARY OF THE INVENTION

In accordance with this invention, there is provided a mixing and deagglomerating apparatus which preferably utilizes replaceable hard faced teeth mounted radially on a smooth disc agitator containing no holes or protrusions. This disc agitator may be used in a round, hexagonal, or octagonal mixing tank with special baffles which perform the several functions of reducing suspension spin, controlling the uniform flow of suspension to beneath and above the agitator disc, and maximizing the delivery of the suspension back to the agitator tips. The apparatus also contains at least one baffle disposed in substantially the same plane as the disk of the agitator.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
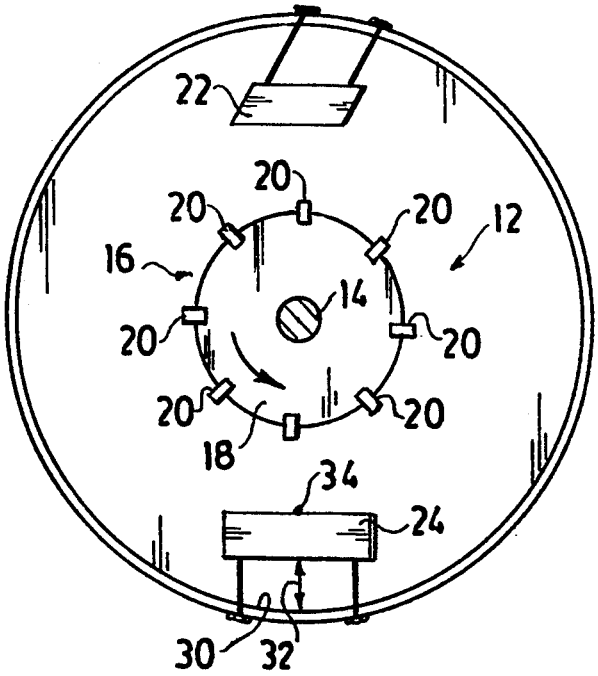
FIG. 1 is a top view of one preferred embodiment of a round tank containing a preferred apparatus of this invention.

The invention relates to a device, and a process utilizing such device, which can be used to effectively destroy deleterious agglomerates which are very prominent in the preparation of high solids suspensions in polar or non-polar liquid vehicles. Such high solids suspensions are commonly used in the preparation of ceramic slips for wet processes, such as slip casting, tape casting, filter pressing, plastic forming, spray drying, and the like; as well as other suspensions such as coal-water slurries, drilling muds, etc.

In one preferred embodiment, the fine powders mixed by the apparatus and process of this invention are particles of quartz and/or feldspar with particle sizes in the range of from about 0.5 to about 75 microns, or clay minerals with particle sizes in the range of from about 0.01 to about 50 microns.

Prior to the time the preferred device and process of this invention are discussed, applicant will first discuss some relevant technical background material.

TECHNICAL BACKGROUND MATERIAL

Most, if not all, ceramic raw materials and other fine powders are more or less severely agglomerated upon receipt at the processing plant. Some natural raw materials, such as clay, have agglomerates of variable strength which cannot be easily broken down to the ultimate particle size in aqueous suspensions. The result is that these materials do not adequately or consistently provide the properties for which they were selected. Other ceramic materials which were chemically prepared, such as aluminum oxide and other electronic ceramic raw materials, are all agglomerated due to the cementing properties of some of the chemical "soup" from which they were precipitated. Others are agglomerated due to the thermal processing they received. All these raw materials must be properly deagglomerated to their ultimate particle size without further comminution if possible. This can only be accomplished at very high agitator tip speeds in excess of about 4,000 feet per minute.

The primary purpose of "blunging" (wet mixing) powders is deagglomeration, and its secondary purpose is blending or mixing. It is imperative that the effectiveness of blunging of the final body composition in the plant must match the effectiveness of deagglomeration of raw materials in sample preparation for characterization.

Applicant has discovered that several factors influence to what extent one can obtain effective blunging. They are impact, turbulence, convection, and time.

With regard to impact, in a blunging environment where a disc agitator is used, the maximum shear energy occurs at the blade tips where velocity gradients are maximum.

Impact is maximized when the solids content and the viscosity are as high as possible.

Turbulence is another factor which must be considered. Compared to impact phenomena, turbulence has lower shear energy, and it exists in the eddy currents behind the blade tips where negative pressure occurs.

Convection is the lowest shear energy mechanism, and it occurs at the boundaries between laminar flow layers in convection away from the agitator.

Some convection, or pumping action, is necessary to continuously deliver fresh slurry or slip back to the blade tips. If a body slip is flocculated and therefore has a high viscosity, the convection flow must also be strong enough to assure that the batch at the top near the tank wall is in sufficient motion to prevent gelation so it does not become stationary. The vortex must also be strong enough to entrain fine powders which are notorious for floating on top of a batch.

The effectiveness of deagglomeration and mixing depends upon a combination of tip speed and time. At any tip speed, deagglomeration will reach a terminal condition after some fixed time, but higher tip speed will provide more agglomeration in the same amount of time. Once the terminal condition is reached at a given tip speed, longer time only increases the temperature of a batch.

DESCRIPTION OF THE PREFERRED EMBODIMENT

FIG. 1 is a top view of one preferred embodiment of a round tank 10 containing a preferred apparatus 12 of this invention.

As is known to those skilled in the art, impellers may be roughly divided into two broad classes: axial flow impellers and radial flow impellers. The classification depends upon the angle the blade makes with the plane of impeller rotation.

The apparatus of this invention is comprised of a radial flow impeller. Radial flow impellers have blades whose faces are parallel to the axis of the drive shaft. The smaller multiblade radial flow impellers are known as turbines. The diameter of a turbine (the outside diameter of the blades) is normally between 0.3 to about 0.6 of the tank diameter. See, e.g., pages 19-4 to 19-6 of Robert H. Perry et al.'s "Chemical Engineer's Handbook," Fifth Edition (McGraw Hill Book Company, New York, 1973).

Referring again to FIG. 1, it will be seen that rotatable shaft 14 is operatively connected to impeller disc 16. The shaft 14/disc 16 assembly is disposed within tank 10.

Figure 6:
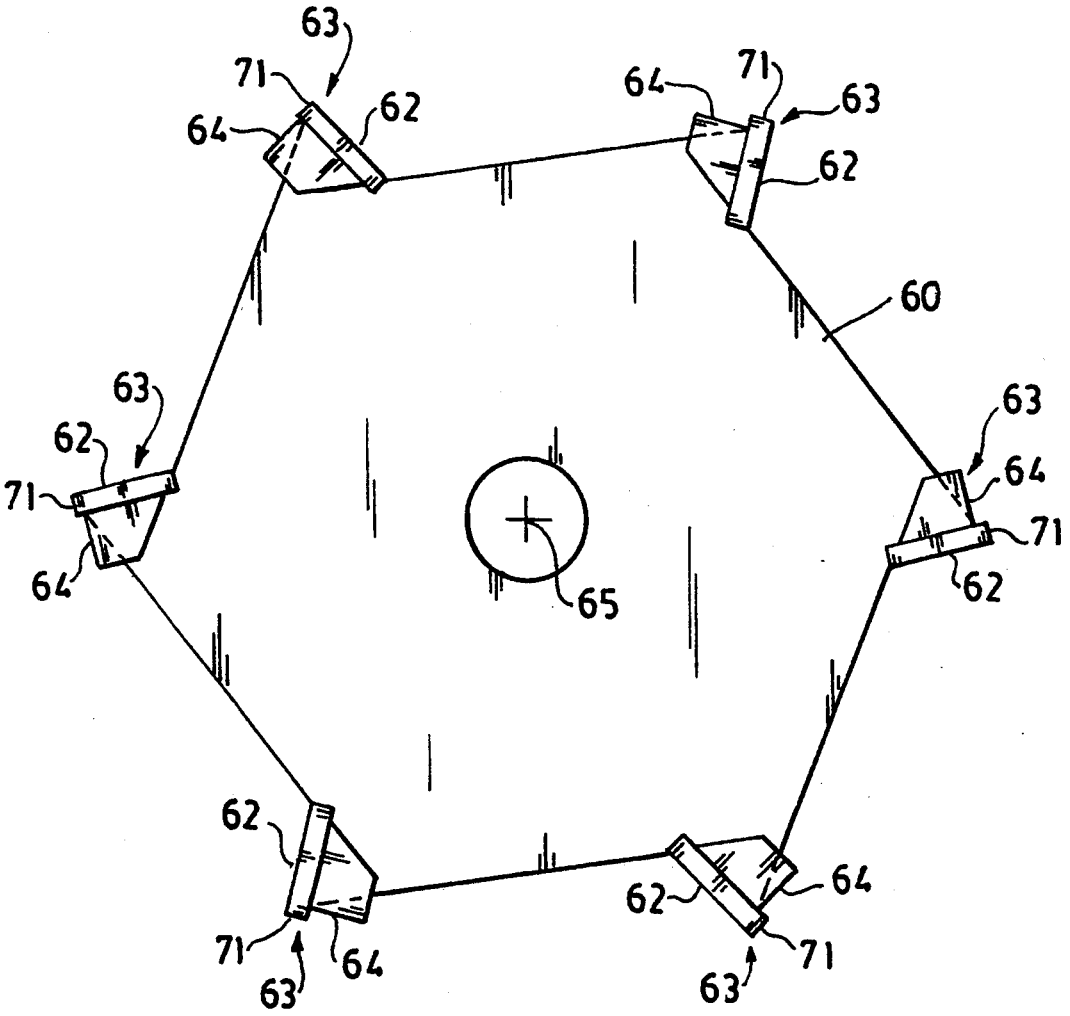
FIG. 6 is a top view of another disc agitator which may be used in the invention.

Impeller disc 16 may be exactly circular, or may be substantially circular, in that specially shaped chords are cut into the circle as shown in FIG. 6, and balanced on shaft 14; in this latter embodiment, each of the tips of compound teeth 63 is substantially equidistant from centerpoint 65.

In general, and referring again to FIG. 1, the diameter of impeller disc 16 is from about 0.2 to about 0.4 times as great as the maximum internal width of tank 10; thus, where tank 10 has a circular cross-section, impeller disc 16 is from about 0.2 to about 0.4 times as great as the internal diameter of the tank.

Referring again to FIG. 1, and in the preferred embodiment illustrated therein, it will be seen that impeller disc 16 is preferably comprised of a flat or substantially flat disc 18 and, attached to disc 18, impeller teeth 20.

In one embodiment, illustrated in FIG. 1, it is preferred to have one agitator tooth connected to flat disc 18 for from about each 3 to about 5 inches of circumference of flat disc 18. It is more preferred to have one agitator tooth for from about each 3.5 to about 4.5 inches of circumference. It is even more preferred to have one agitator tooth for about each 4.0 inches of circumference.

In general, disc 16 has a thickness which is usually from about 0.1 to about 0.4 inches. Furthermore, the frontal area of tooth 20 (see FIGS. 4 and 5) generally is may vary from about 0.1 to about 1 square inch; tooth 20 may be $\frac{1}{4}\times 1\theta$ inch, it may be $1\times 1$ inch, etc.

Figure 7:
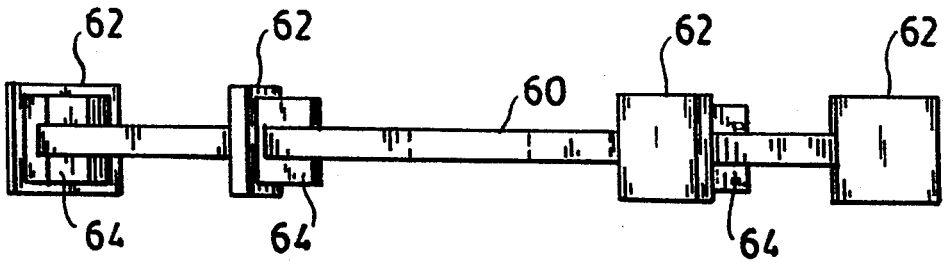
FIG. 7 is a side view of the disc agitator of FIG. 6.

Referring to FIGS. 6, 7, 8, and 9, if a $\frac{1}{8}$ inch thick disc 60 is used, tooth 63 may be a compound design (as shown in FIG. 7) for a frontal plate up to about 1 inch by 1 inch. It is preferred that a 0.25 inch thick disc with a diameter of 8 inches have 6 teeth around its circumference, a frontal area per tooth of $\frac{1}{2}$ inch by $\frac{1}{2}$ inch, and a tank diameter of from about 22 to about 24 inches; a 0.25 inch thick disc with a diameter of 12 inches have 9 teeth around its circumference, a frontal area per tooth of $\frac{1}{2}$ inch by $\frac{1}{2}$ inch, and a tank diameter of from about 34 to about 40 inches; a 0.25 inch thick disc with a diameter of 16 inches have 13 teeth around its circumference, a frontal area per tooth of $\frac{1}{2}$ inch by $\frac{1}{2}$ inch, and a tank diameter of from about 46 to about 53 inches; a 0.375 inch thick disc with a diameter of 20 inches have 16 teeth around its circumerference, a frontal area per tooth of $\frac{5}{8}$ inch by $\frac{5}{8}$ inch, and a tank diameter of from about 57 to about 67 inches; a 0.375 inch thick disc with a diameter of 24 inches have 18 teeth around its circumference, a frontal area per tooth of $\frac{5}{8}$ inch by $\frac{5}{8}$ inch, and a tank diameter of from about 68 to about 80 inches; a 0.5 inch thick disc with a diameter of 28 inches have 22 teeth around its circumference a frontal area per tooth of $\frac{3}{4}$ inch by $\frac{3}{4}$ inch, and a tank diameter of from about 80 to about 93 inches; a 0.5 inch thick disc with a diameter of 30 inches have 24 teeth around its circumference, a frontal area per tooth of $\frac{3}{4}$ inch by $\frac{3}{4}$ inch, and a tank diameter of from about 86 to about 100 inches; and a 0.5 inch thick disc with a diameter of 34 inches have 28 teeth around its circumference a frontal area per tooth of $\frac{1}{2}$ inch by $\frac{1}{2}$ inch, and a tank diameter of from about 97 to about 113 inches.

It will be apparent to those skilled in the art that the aforementioned embodiments are merely illustrative and that, in general, the diameter of the disc 18 may range from about 6 to about 40 inches, the thickness of disc 18 may range from about 0.1 to about 0.5 inches, the frontal area per tooth may range from about $\frac{1}{4}$ inch by $\frac{1}{4}$ inch to about 1 inch by 1 inch.

Referring again to FIG. 1, it will be seen that the preferred deagglomerating assembly depicted is preferably comprised of a baffle 24 and, optionally, baffle 26. It will be seen that disc 18 is disposed a measured distance from the bottom of the tank 10 between the measured radius and the diameter of the disc; in one embodiment, it is preferred to dispose disk 18 a distance from the bottom of tank 10 which is from about 0.8 to about 1.5 times as great as the radius of disc 18.

At least one baffle is disposed within tank 10. However, in the preferred embodiment illustrated in FIG. 1, inside the mixing tank 10 are mounted two baffles 22 and 24 which are designed to (1) reduce the "spin" of the suspension or liquid imparted by the flat tipped teeth of the disc agitator, and (2) "steer" the suspension or liquid in such a manner as to maximize the uniformity of mixing below and above the disc, and to maximize the rate of return of the suspension back to the disc. Although only two baffles are shown in FIG. 1 several baffles 22 and 24 are comprehended by this invention depending upon the viscosity and/or the solids content of the suspension.

Referring again to FIG. 2, it will be seen that baffle 24 is mounted on the wall of tank 10 wall at an angle 26 formed with horizontal line 28 (which is parallel to the plane of disc 18) and which "steers" the suspension in an upward direction, producing a negative fluid pressure below the agitator which in turn pulls suspension beneath the agitator at some point(s) opposite the baffle.

It is preferred that angle 26 be from about 20 to about 45 degrees and, more preferably, from about 30 to about 40 degrees above or below the plane of disc 18.

Referring again to FIG. 1, and in the preferred embodiment illustrated therein, it will be seen that baffle 24 is preferably spaced from inner wall 30 of tank 10 at a distance 32 which preferably is at least about 2 inches from inner wall 30. In one embodiment, the baffle 24 is spaced from inner wall 30 at a distance of from about 2 to about 4 inches.

Figure 2:
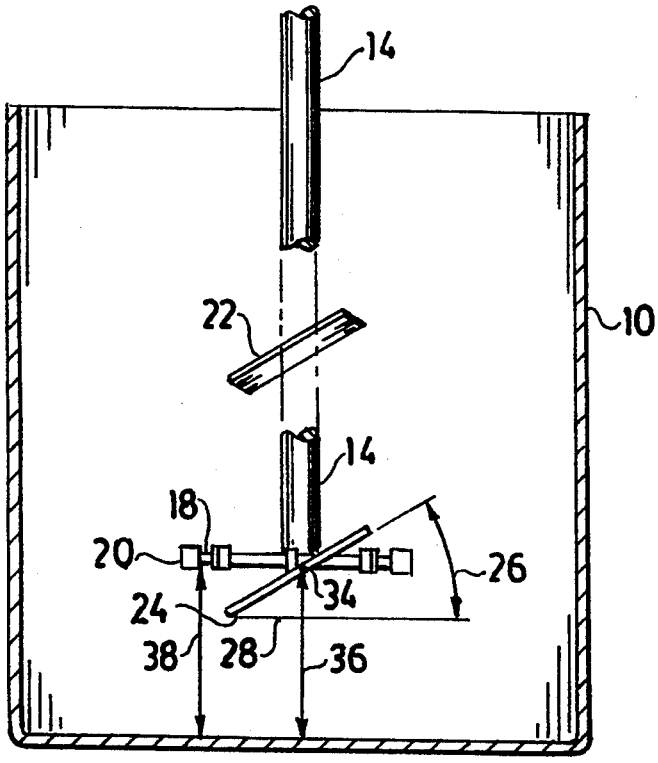
FIG. 2 is a sectional side view of the apparatus of FIG. 1.

Referring to FIG. 2, and in the preferred embodiment illustrated therein, it will be seen that the midpoint 34 of baffle 24 is at a height 36 which is from about 0.9 to about 1.1 times as great as the height 38 of disc 18. In an even more preferred embodiment, baffle 24 midpoint 34 is substantially coplanar with disc 18.

In one preferred embodiment, illustrated in FIGS. 1 and 2, in addition to baffle 24, the apparatus also is comprised of baffle 22. In this embodiment, it is preferred that baffle 22 be mounted at a compound angle in order to "steer" the suspension both downward as well as inward toward the mixing tank centerline for improved delivery of suspension back to the agitator, so long as the entrainment vortex is not destroyed. That is, baffle 22 may also be tipped at some angle to the plane of the agitator.

Baffle 22 therefore preferably serves a double purpose and thus is preferably mounted on the tank wall at a compound angle above the agitator in order to "steer" the suspension both downward (thus reducing the depth of the vortex) and inward toward the drive shaft of the agitator (thus increasing the rate of return to the agitator tips). In the case of low viscosity liquids, this allows a larger fraction of the mixing tank to be filled with suspension.

To better understand the aforementioned compound angle mounting configuration, consider another hypothetical disc mounted on the drive shaft at the same level as baffle 22. Baffle 22 is first angled downwardly between from about 20 to about 45 degrees in the same plane as the radius of this upper disc in order to reduce the depth of the vortex by "steering" the suspension downward. It is then also angled upwardly, at an angle of from about 20 to about 45 degrees, at the inside edge of the baffle, nearest the mixing tank centerline, while retaining the first angle downward. This second angle additionally forces the suspension toward the centerline of the mixing tank into the vortex for more rapid circulation of the suspension back to the agitator tips.

The widths of baffles 24 and/or 22 may vary, and generally they are from 0.05 to about 0.1 times as inner diameter of tank 10.

Baffles 24 and/or 22 preferably have a rectangular shape, although other shapes may also be used. It is preferred that the baffles be constructed of a substantially rigid material (such as steel or stainless steel) and have a thickness which generally ranges from about 0.25 to about 0.5 inches.

As will be appreciated by those skilled in the art, several agitator discs 18 may be mounted on a single drive shaft 14 and several tanks with baffle configurations on the walls may be connected vertically atop one another partially separated from each other by annular rings connecting the outer walls of the tanks, while permitting access of the liquid or suspension through the open center of the annulus from one to the next tank section. Such a configuration will provide a continuous deagglomerating or mixing apparatus where the liquid or suspension is pumped into the bottom of the stack of tanks at a rate determined by the desired residence time within the tank, and exiting from the top tank by simple overflow.

Figure 3:
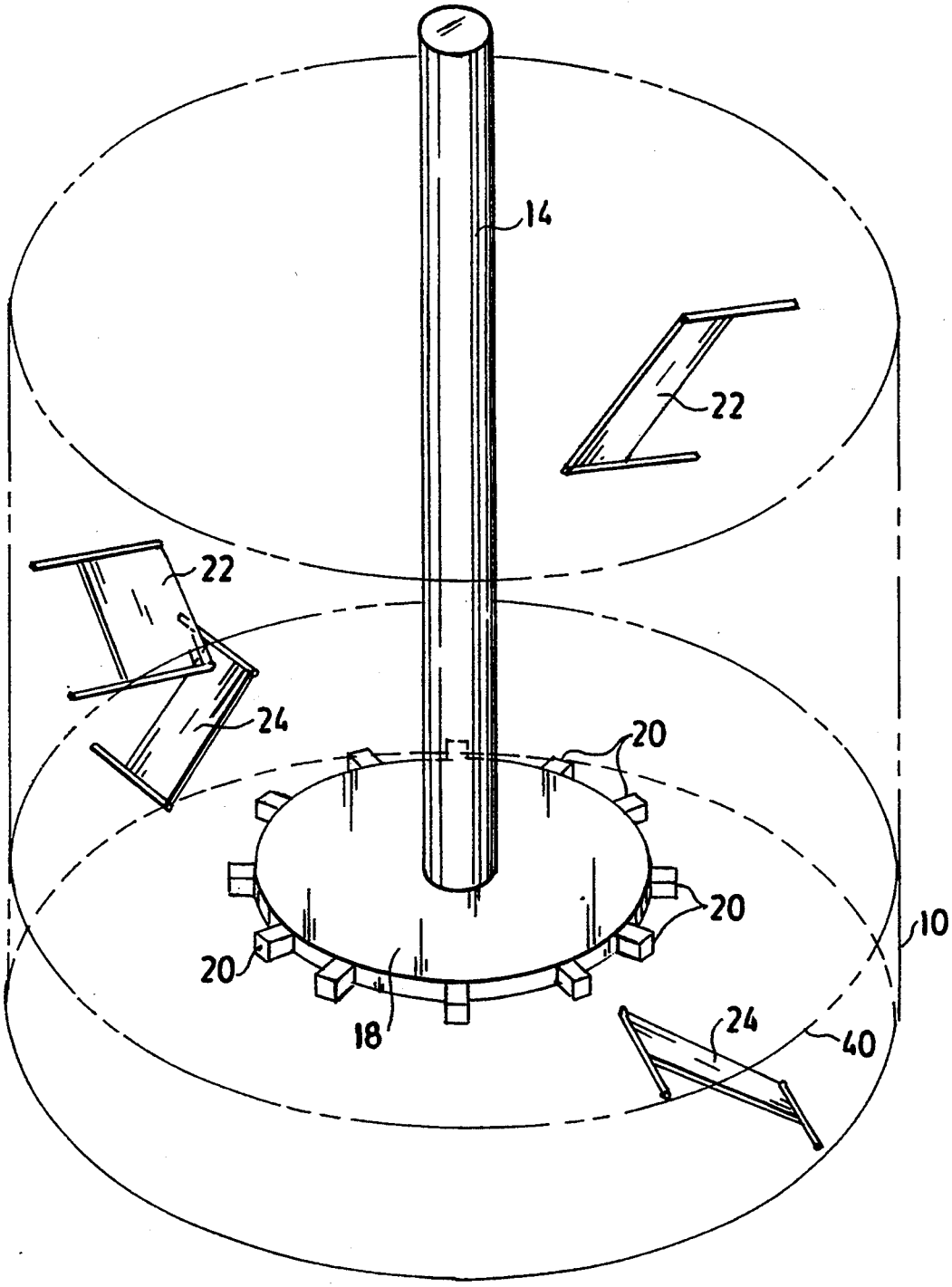
FIG. 3 is a schematic representation of another embodiment of a round tank containing a preferred apparatus of the invention.

FIG. 3 is a schematic representation of another preferred embodiment of a round tank containing a preferred apparatus of the invention. Referring to FIG. 3, it will be seen that round tank 10 has disposed therein disk 18, which is rotatably mounted on shaft. The plane of disk 18 is indicated in phantom as line 40. In this embodiment, two baffles 24 are mounted on the inside wall of tank 10 in the plane of disk 18 and line 40; and two other baffles 22 are also mounted on the inside wall of tank 10, above the plane of disk 18 and phantom line 40.

Figure 4:
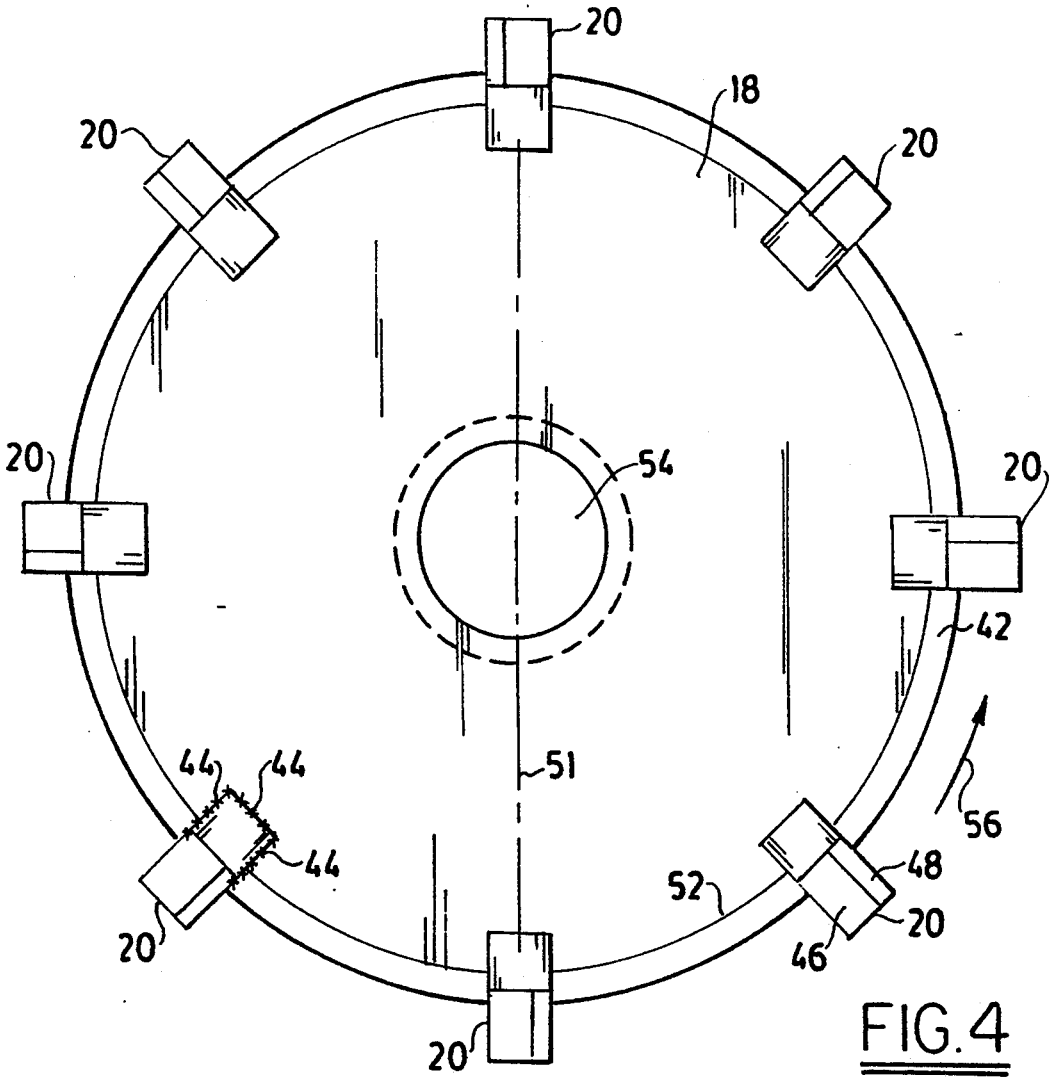
FIG. 4 is a top view of the disc agitator used in the apparatus of FIG. 1.

FIG. 4 is a top view the disk 18 of FIG. 1. As will be seen by reference to FIG. 4, disk 18 has teeth 20 removably attached to it.

Disk 18 may be fabricated by conventional means, with radial slots adapted to receive teeth 20. Thus, by way of illustration and not limitation, one may machine the appropriate circular cross-section into a metal plate and, thereafter, machine the radial slots into the perimeter of such circular plate. The teeth 20 may then be inserted into the radial slots and fastened using conventional welding or brazing techniques.

When one or more of teeth 20 require replacement, they may be removed. If such teeth were inserted by welding, they may be removed by machining. If such teeth were inserted by brazing, they may be removed by heating.

Referring again to FIG. 4, and in the preferred embodiment illustrated therein, it will be seen that the rim 42 of disk 14 is preferably chamfered at an angle of from about 30 to about 45 degrees.

In the embodiment of FIG. 4, the teeth 20 have been welded to disk 18. Thus, referring to welding symbols 44, it will be seen that it is preferred to weld teeth 20 flush with the top and bottom surfaces of disk 18.

Referring again to FIG. 4, it will be seen that, in the embodiment depicted, a compound tooth 20 is preferably used. For the sake of simplicity, only the parts of two compound tooth designs are identified by numerals in FIG. 5.

Figure 5:
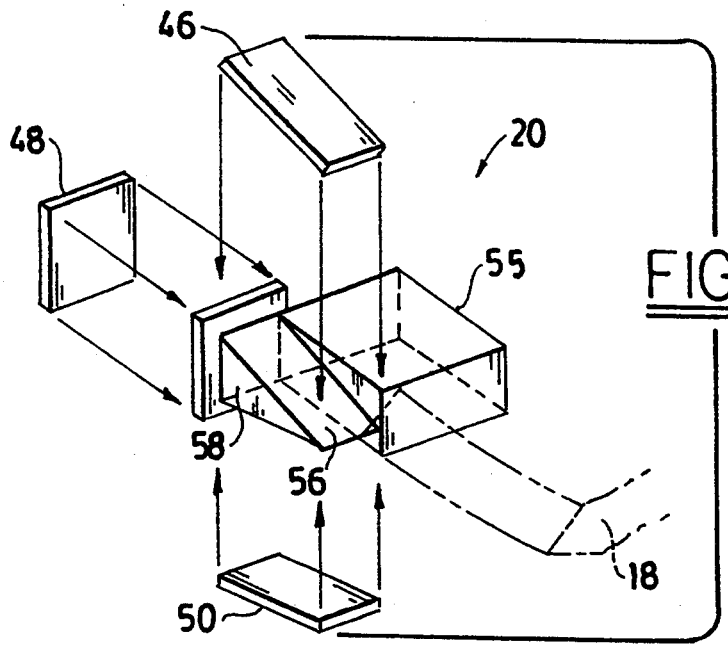
FIG. 5 is an exploded schematic view of one preferred tooth design utilized in the disk agitator of FIGS. 3.

Compound tooth 20 is preferably comprised of a top plate 46, a front plate 48, and a bottom plate 50 which is beneath top plate 46 (not shown in FIG. 4, but see FIG. 5). As is illustrated in FIG. 4, it is preferred that substantially the entire tooth face 48 extend beyond the point 52 at which the chamfered rim 42 begins.

In the embodiment illustrated in FIG. 4, a center mounting hole 54 is illustrated for disk 18. As will be apparent to those skilled in the art, many other means for mounting a disk 18 may also be used.

In the embodiment illustrated in FIG. 4, the disk 18 is rotating in the direction of arrow 56 in order to present tooth face 48 to impact with the suspended solids.

Referring again to FIG. 4, it will be seen that each of teeth 20 is preferably radially mounted.

In one embodiment, not shown, each of teeth 20 is mounted so that it forms an angle between front face 48 of tooth 20 and the centerline 51 of disk 18 of from about 5 to about 20 degrees.

FIG. 5 is an exploded schematic view of one preferred tooth design utilized in the disk agitator of FIGS. 3 and 4. Referring to FIG. 5, it will be seen that compound tooth 20 is preferably comprised of a top plate 46, a front plate 48, and a bottom plate 50 which is beneath top plate 46. These plates 46, 48, and 50 are preferably assembled onto steel tooth blank 55.

FIG. 6 is a top view of another preferred agitator disc 60 which is comprised of a multiplicity of compound teeth 63. Each such compound tooth 63 is comprised of a front plate 62 (c.f. FIG. 5, elements 20 and 48) and a mounting shoe 64 to support it, which is preferably brazed onto a disc 60 (such as, e.g., a ⅛ inch thick disc 60) which has been cut from a circular shape to the shape. In this preferred embodiment, the distance from the centerpoint 65 to the tip 71 of each of the teeth 63 is substantially equal.

Figure 8:
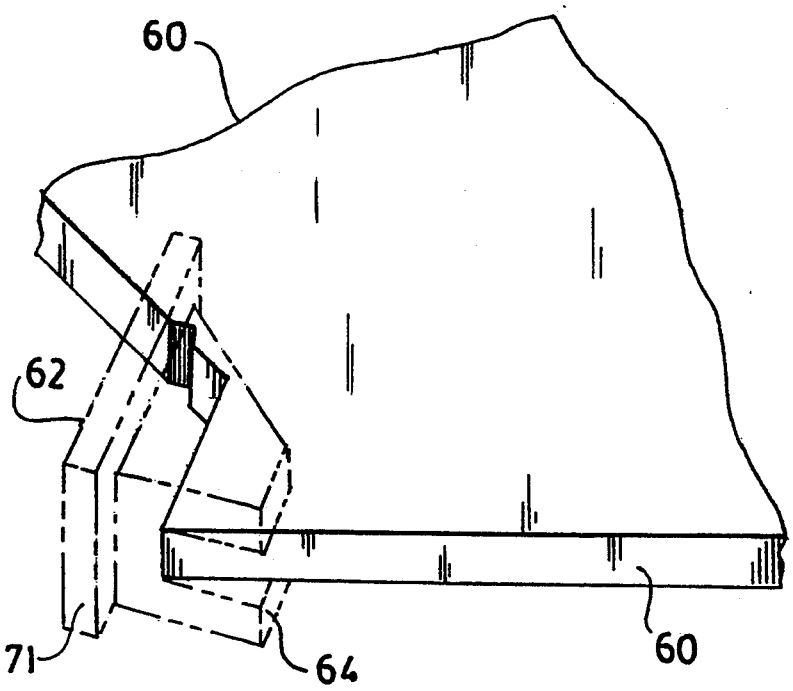
FIG. 8 is an enlarged partial perspective view of the disc agitator of FIG. 6.
Figure 9:
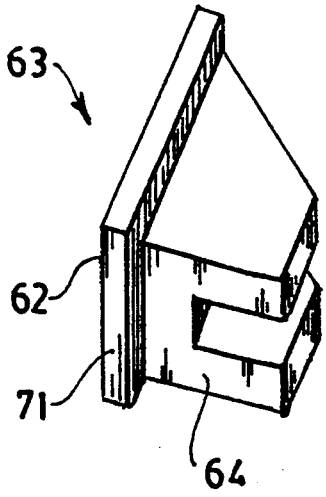
FIG. 9 is a perspective view of the compound tooth used in the disc agitator of FIG. 6.

FIG. 7 is a side view of the agitator disc 60 of FIG. 6. FIG. 8 is a partial, enlarged perspective view of the disk 60 of FIG. 6. FIG. 9 is a perspective view of one of the compound teeth 63.

As will be apparent to those skilled in the art, a tooth configuration may be cut into a steel blank by conventional machining methods. Thus, by way of illustration, one may shape a substantially rectangular steel blank so that it becomes an integral structure with surface 56 forming an acute angle with wall 58. As will be apparent to those skilled in the art, many other tooth configurations may be machined from many different sizes and shapes of steel blanks, or other suitable blanks.

What is important, however, is that each surface of the tooth which impacts the particles in the suspension being deagglomerated be a plate of a suitable, hard, ceramic material. Thus, each of plates 46, 48, 50, and 62 must consist essentially of such hard, ceramic material. Thus, e.g., plate 48 encounters frontal impact as the major contributor to deagglomeration. Thus, e.g., plates 46 and 50 encounter secondary impact as a result of the particle suspension flowing over the tooth.

Referring again to FIG. 5, it will be seen that no portion of steel tooth 55 is exposed to impact with particulate matter. The plates 46, 48, and 50 are joined to the corresponding surfaces in tooth 55 by conventional brazing, cementing, or fastening techniques well known to those skilled in the art; and, when one or more of such plates are worn, they may also be removed and replaced by such conventional techniques.

Referring again to FIG. 5, it will be seen that compound tooth 20 is secured within disk 18 (shown in phantom).

Each of plates 46, 48, 50, and 62 consist essentially of one or more ceramic materials which, preferably, are selected from the group consisting of tungsten carbide, silicon carbide, aluminum oxide, zirconium dioxide, and the like. These materials, which are well known in the cutting tool trade, are described in the January, 1991 issue of "Ceramic Industry."

In one preferred embodiment, each of plates 46, 48, 50, and 62 consists essentially of tungsten carbide and preferably has a thickness of from about 0.05 to about 0.15 inches.

In one embodiment, not shown, each of teeth 20 is an integral structure consisting essentially of a material selected from the group consisting of tungsten carbide, silicon carbide, alumina, zirconia, and the like. These integral teeth may be formed from the ceramic material by conventional forming methods.

The process of applicant's invention

In the process of applicant's invention, primary deagglomeration unexpectedly occurs to a substantial extent. This deagglomeration phenomenon is most noticeable at a tooth 20 tip speed of above about 3,000 feet per minute and, preferably, a tip speed above 4,000 feet per minute.

In one embodiment, applicant's device is used to deagglomerate a clay slurry for a period of from about 30 minutes to about 2 hours.

In applicant's process, it is preferred that the slurry being deagglomerated have a solids content of at 30 volume percent. It is also preferred that the viscosity of the suspension to be deagglomerated be below about 3,000 centipoise. If a suspension has a viscosity higher than this, a suitable viscosity-reducing agent (such as, e.g., a dispersant) may be added. See, e.g., U.S. Pat. No. 4,282,006, the disclosure of which is hereby incorporated by reference into this specification.

It is also preferred, in some embodiments, to raise the speed of the agitator disk to its desired at a rate commensurate with maintaining coverage on the agitator disc.

It is also preferred, in applicant's process, that the agitator disk 18 remain submerged within the slurry to be deagglomerated during the deagglomeration.

The following examples are presented to illustrate the claimed invention but are not to be deemed limitative thereof. Unless otherwise specified, all parts are by weight and all temperatures are in degrees Centigrade.

EXAMPLES

In these experiments, a circular steel disk with a thickness of 0.25 inches, a diameter of 6 inches, and a frontal area of ½ inch by ½ inch was constructed in accordance with FIGS. 1–5 using tungsten carbide plates for plates 46, 48, and 50. The effects of the carbide disc disperser were compared with a conventional axial fan turbine (combination axial and radial fan agitator run at 1350 feet per minute tip speed).

In these experiments, particle size analysis was run on each sample using a Micromeritics Sedigraph 5100. Only the volume percent concentrations of particles less than 5 microns and 0.2 microns are reported here.

The specific surface areas (SSA) of the samples were measured using a Micromeritics Flosorb. The Bingham yield stress and plastic viscosity of the samples were calculated from two readings on a Brookfield viscometer at 6 and 60 revolutions per minute spindle speed.

EXAMPLE 1

In this experiment, a slurry of ball clay at a specific gravity of 1730 grams per liter was deagglomerated for one hour.

Prior to deagglomeration, 60.3 percent of the particles in the slurry were smaller than 5.0 microns, and 10.6 percent of the particles were smaller than 0.2 microns.

After deagglomeration using a tip speed of 3920 feet per minute, 63.1 percent of the particles in the slurry were smaller than 5 microns, and 16.2 volume percent of the particles in the slurry were smaller than 0.2 microns.

After deagglomeration using a tip speed of 5890 feet per minute, 65.7 percent of the particles in the slurry were smaller than 5 microns, and 16.8 percent of the particles in the slurry were smaller than 0.2 microns.

EXAMPLE 2

In this experiment, a slurry of ball clay at a specific gravity of 1400 grams per liter was deagglomerated for one hour.

Prior to deagglomeration, 81.3 percent of the particles in the slurry were smaller than 5.0 microns, and 30.8 percent of the particles were smaller than 0.2 microns.

After deagglomeration using a tip speed of 4200 feet per minute, 81.95 percent of the particles in the slurry were smaller than 5 microns, and 35.3 volume percent of the particles in the slurry were smaller than 0.2 microns.

After deagglomeration using a tip speed of 5600 feet per minute, 81.8 percent of the particles in the slurry were smaller than 5 microns, and 36.2 percent of the particles in the slurry were smaller than 0.2 microns.

EXAMPLE 3

In this experiment, a slurry of kaolin clay at a specific gravity of 1730 grams per liter was deagglomerated for one hour.

Prior to deagglomeration, 57.7 percent of the particles in the slurry were smaller than 5.0 microns, and 6.7 percent of the particles were smaller than 0.2 microns.

After deagglomeration using a tip speed of 4500 feet per minute, 64.4 percent of the particles in the slurry were smaller than 5 microns, and 14.2 volume percent of the particles in the slurry were smaller than 0.2 microns.

After deagglomeration using a tip speed of 6000 feet per minute, 67.5 percent of the particles in the slurry were smaller than 5 microns, and 14.2 percent of the particles in the slurry were smaller than 0.2 microns.

EXAMPLE 4

In this experiment, a slurry of kaolin clay at a specific gravity of 1300 grams per liter was deagglomerated.

Prior to deagglomeration, 77.4 percent of the particles in the slurry were smaller than 5.0 microns, and 16.3 percent of the particles were smaller than 0.2 microns.

After deagglomeration using a tip speed of 4760 feet per minute, 78.9 percent of the particles in the slurry were smaller than 5 microns, and 18.2 volume percent of the particles in the slurry were smaller than 0.2 microns.

After deagglomeration using a tip speed of 5950 feet per minute, 79.8 percent of the particles in the slurry were smaller than 5 microns, and 22.5 percent of the particles in the slurry were smaller than 0.2 microns.

In the experiments of Examples 1–4, the specific surface area of the slurries powders were measured; in no case did they change, as would expected if particle grinding were occurring.

It is apparent from these experiments that deagglomeration was thus responsible for the change in particle size distribution. To the best of applicant's knowledge and belief, no other apparatus deagglomerates crowded particles suspensions as effectively.

I claim:

1. An apparatus for deagglomerating powder in a mixture of liquid and powder, wherein said apparatus is comprised of a mixing tank, an agitator disk disposed within said mixing tank, said disk rotating in a horizontal plane, a means for rotating said agitator disk, and a first baffle, wherein:

said agitator disk is smooth, flat, and has a maximum cross-sectional dimension of from about 6 to about 40 inches, wherein said maximum cross-sectional dimension of said agitator disk is from about 0.2 to about 0.4 times as great as the maximum internal width of said mixing tank;

said agitator disk is comprised of a multiplicity of compound teeth radially and removably attached to the perimeter of said disk, wherein the distance between adjacent compound teeth on said perimeter of said agitator disk is from about 3 to about 5 inches;

said agitator disk has a thickness of from about 0.1 to about 0.5 inches, and a frontal area of said compound teeth attached to said agitator disk is from about 0.25 inches by 0.25 inches to about 1.0 inch by 1.0 inch;

each of said compound teeth is comprised of a substrate to which is attached a front plate, wherein said front plate consists essentially of ceramic material; and said first baffle is mounted on the inner wall of said mixing tank at an angle of from about 20 to about 45 degrees to said horizontal plane of said disk and at a distance of at least about 2 inches from said inner wall.

2. The apparatus as recited in claim 1, wherein said apparatus is comprised of a second baffle mounted on the inner wall of said mixing tank.

3. The apparatus as recited in claim 1, wherein each of said compound teeth is removably attached to said smooth, flat disk by welding.

4. The apparatus as recited in claim 1, wherein each of said compound teeth is removably attached to said smooth, flat disk by brazing.

5. The apparatus as recited in claim 1, wherein the edge of said smooth, flat disk is chamfered.

6. The apparatus as recited in claim 1, wherein said ceramic material is tungsten carbide.

* * * * *